United States Patent [19]

Novarini

[11] Patent Number: 4,569,418

[45] Date of Patent: Feb. 11, 1986

[54] FIRE ESCAPE AND EXTINCTION SYSTEM

[76] Inventor: Augusto Novarini, Via Privata F. Lassalle 12, Milano, Italy

[21] Appl. No.: 589,277

[22] Filed: Mar. 14, 1984

[30] Foreign Application Priority Data

Jan. 9, 1984 [IT] Italy ..... 19079 A/84

[51] Int. Cl.[4] ..... A62B 1/02

[52] U.S. Cl. ..... 182/51; 182/63; 182/82; 187/6

[58] Field of Search ..... 182/82, 63, 51, 47; 187/8, 6

[56] References Cited

U.S. PATENT DOCUMENTS

| | | | |
|---|---|---|---|
| 71,791 | 12/1867 | Robinson | 182/146 |
| 202,009 | 4/1878 | Haas | 182/47 |
| 2,647,675 | 8/1953 | Bernett | 182/82 |
| 3,945,469 | 3/1976 | Dorcich | 187/6 |
| 4,010,822 | 3/1977 | Banner | 182/47 |
| 4,018,306 | 3/1977 | Lyons | 187/6 |
| 4,350,224 | 9/1982 | Jochum | 182/82 |
| 4,406,349 | 9/1983 | Vilchek | 182/82 |
| 4,406,351 | 9/1983 | Littlejohn | 182/51 |
| 4,469,198 | 9/1984 | Crump | 187/8 |

FOREIGN PATENT DOCUMENTS

| | | | |
|---|---|---|---|
| 520325 | 3/1940 | United Kingdom | 182/51 |

*Primary Examiner*—Reinaldo P. Machado

*Attorney, Agent, or Firm*—Guido Modiano; Albert Josif

[57] ABSTRACT

A fire escape and extinction system is disclosed which can be used in the event of fire outbreak in high buildings, in particular in "skyscrapers," and comprises a transportable booth having a partition grid extending parallel to the booth floor and defining a lower chamber, which accommodates booth driving and locking means cooperating with a booth translating means, and an upper chamber which includes, in its portion remote from the partition grid, a space filled with a cooling fluid. The booth interior is further provided with at least one channel for topping up the cooling fluid contained in said jacket, and at least one communication ladder between the lower and upper chambers.

10 Claims, 9 Drawing Figures

FIRE ESCAPE AND EXTINCTION SYSTEM

BACKGROUND OF THE INVENTION

This invention relates to a fire escape and extinction system particularly for high buildings.

It is general practice nowadays, in the event of a building catching fire, to have a fire brigade to rescue its occupants and extinguish the fire, the firemen employing to this aim truck-mounted telescoping ladders, wherefrom the fire is fought by means of fire hoses.

When people are trapped in the burning building, these are usually expected to jump out of windows and balconies onto stretched jumping canvas sheets to cushion their fall. The issue may be highly dramatic where the building happens to be a tall one, such as a tower building or "skyscraper", in which case the aforementioned measures cannot provide any effective solution to the problem posed by height: in fact, ladders cannot span the full height of the building far above about thirty meters, and jumping sheets become unusable on account of the speed at which a person would fall to the ground. Moreover, operating difficulties are also encountered sometimes with the various fire fighting arrangements, or such arrangements may prove inadequate to successfully fight a conflagration of unusually large size.

SUMMARY OF THE INVENTION

It is an object of this invention to obviate such prior deficiencies by providing a fire escape system with a booth structure particularly useful for high buildings, which may be easily transported towards a building on fire and which enables any level of a building on fire to be reached without the booth occupants being exposed to the intense heat generated by the fire.

Another object of this invention is to provide a fire escape booth structure which can safely accommodate on its inside persons who have been trapped by fire in a building.

It is a further object of the invention to provide a fire escape booth structure which can withstand the high temperatures of a conflagration without its proper operation being affected thereby.

These and other objects are achieved by a fire escape and extinction system for buildings, according to the invention, comprising a transportable booth having means allowing transportation of the booth to a building on fire, at least one vertically extending track structure on an external wall of said building, said booth having driving and locking means cooperating with mechanical engagement means extending along said building for carrying the booth on a desired height of the building, means being also provided for cooling said booth during escape and extinction operations.

BRIEF DESCRIPTION OF THE DRAWINGS

Further features and advantages of the invention will be more clearly understood from the following description of a preferred, but not exclusive, embodiment of the booth structure according to the invention, as shown by way of example and not of limitation in the accompanying drawing, where.

DESCRIPTION OF THE PREFERRED EMBODIMENTS

Figures 1, 2, 3, 9:
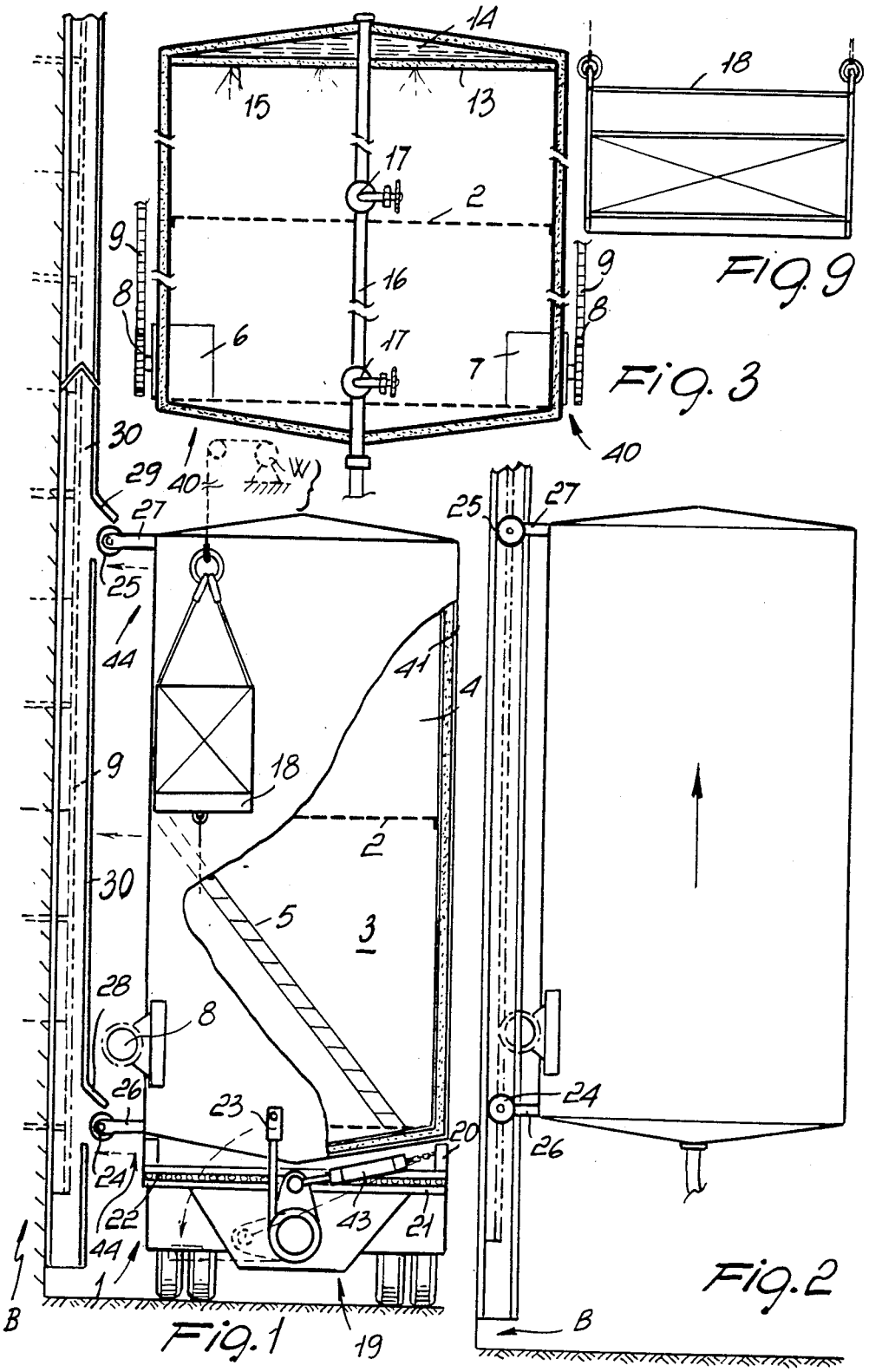
FIG. 1 is a partly cut-away, side elevation view of this booth structure as mounted on means of transportation and ready for insertion into the rails of this invention.
FIG. 2 is a schematical side elevation view of this booth structure, as engaged in the related rails according to the invention.
FIG. 3 is a sectional side elevation view of the booth.
FIG. 9 shows a schematic view of the auxiliary platform.
Figure 4:
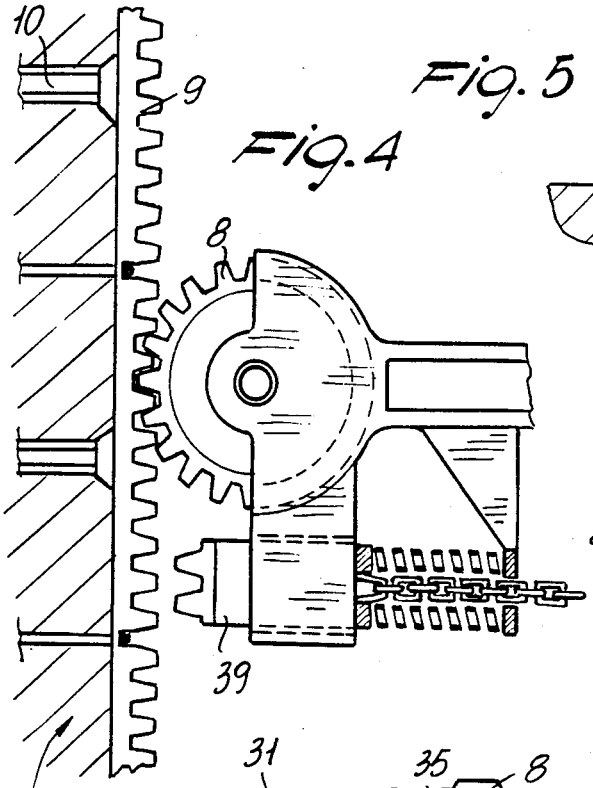
FIG. 4 is a side elevation view showing the gear wheel meshing with a rack and carrying the toothed punch according to this invention.

Making reference to the drawing FIGS. 1—3, a fire escape booth or cage structure according to the invention, generally designated with the reference numeral 1, comprises a partition grid 2 extending parallel to the floor of the booth 1 and defining a lower chamber 3 and an upper chamber 4 on the booth interior which are placed in mutual communication by a ladder 5.

Accommodated within the lower chamber 3 of the booth are a driving means 40 including two motors 6 and 7 mounted to opposed walls of the booth to drive the booth up and down along an outside wall of a building B.

Each said motors drives a gear wheel 8 accommodated externally to the booth and meshing each with a rack 9; the racks extend parallel to each other over the full height of a building B, along one wall thereof, and are secured to the latter as by means of bolts 10 advantageously extending from one side of the building to another.

Figure 5:
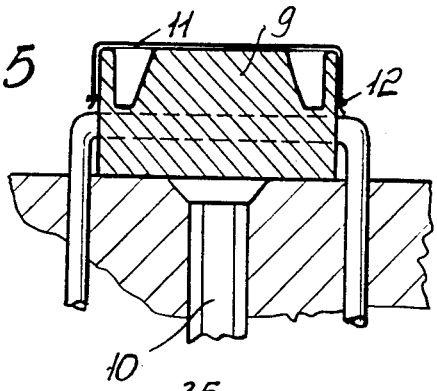
FIG. 5 is a sectional front elevation view of the rack as covered with a protective film according to this invention.
Figure 8:
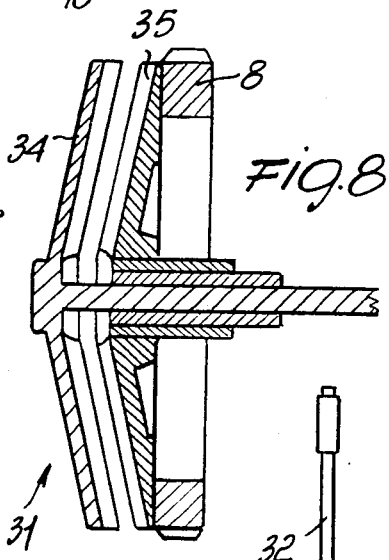
FIG. 8 is a sectional side elevation view showing the assembly formed by the concave and convex wheels in conjunction with the gear wheel according to this invention.
Figure 6:
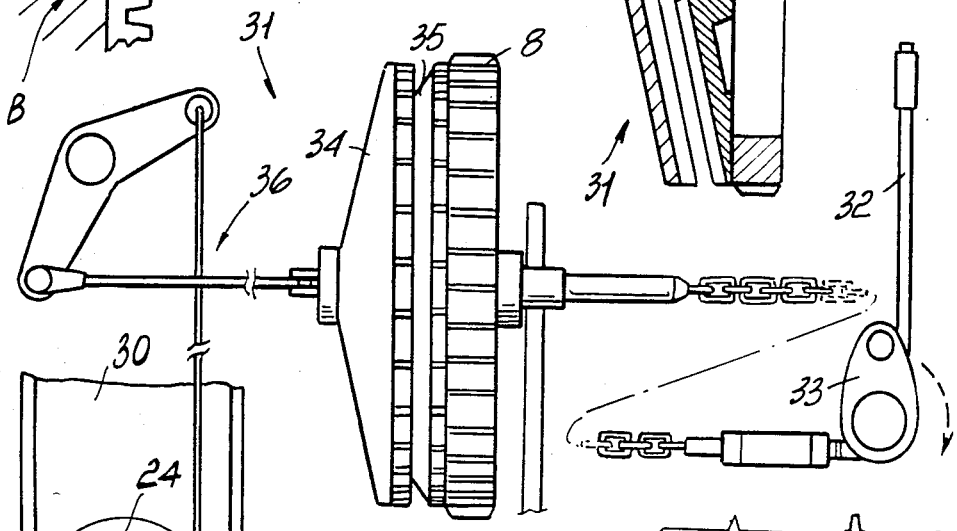
FIG. 6 is a side elevation view illustrating the operation of the booth locking means according to this invention.
Figure 6:
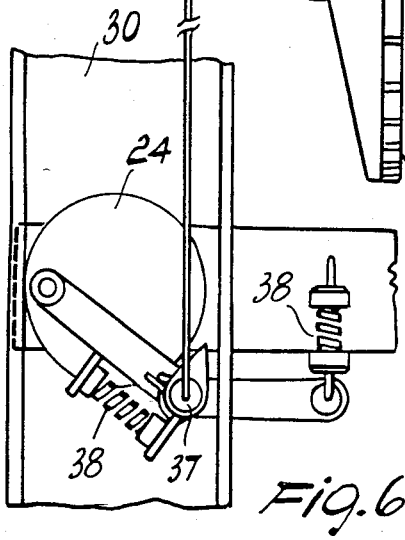
Figure 7:
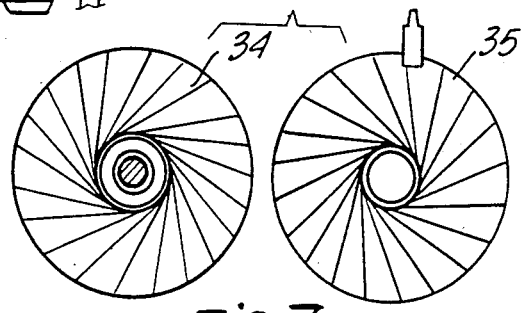
FIG. 7 is a plan view showing the concave wheel and convex wheel according to the invention.

The racks 9, which on account of being located externally to the building and, therefore, liable to have their teeth iced up and deteriorate if exposed bare to weather agents, are covered with a protective film 11 which is secured to the sides of the racks 9 by rivets 12 and advantageously formed from a plastic material to be torn away as the gear wheels are caused to run along them (see FIG. 5).

The booth upper chamber 4 has at its top portion, and facing the grid 2, a wall 13 defining a space advantageously containing a cooling fluid 14 which, in the event of fire, would be atomized into the booth interior through atomizer nozzles 15 in order to keep the interior temperature well below the outside temperature of the booth.

For this reason, all the outer walls of the booth are covered with a layer of a ceramic fiber material 41 which enables maintenance of an acceptable temperature within the booth even when, during a conflagration, the outside temperature reaches very high values. Inside the wall 13, the cooling fluid 14 is topped up through a channel 16 which is suitably connected to a fire hose equipping the elevator and being connected to a fire hose on the fire truck.

The channel 16 has, located within each chambers 3 and 4, a valve 17 for connecting thereto auxiliary means of the kind of water nozzles, not shown in the drawing, for abating flames. Of course the booth presents openings for allowing the passage of fire hoses as well as at least one door for allowing people and fire-men to get in and out the booth. For example one door can be arranged on the booth side facing the building wall, whereas it is possible to arrange a further door on the opposite booth side.

The booth carries externally, as by means of a fast winch W (FIG. 1), an auxiliary platform 18 (illustrated in FIG. 9) which has both an anchorage on the booth itself and an anchorage on the ground for the ropes wherealong it runs, such that the ascending stream caused by the fire cannot induce oscillations causing the footbridge to strike the building structure.

The cited booth is transported to a location flanking the building by means of an automobile vehicle 21 which is provided with an engagement device 19 for transferring the booth from the automobile vehicle to the wall that it is expected to climb.

The device 19 includes a box 20, carrying the booth slidably on top of the frame of the automobile vehicle 21 through the intermediary of ball bearings 22, and is moved, according to the arrow 44, by a force applied transversely to the box 20 on turning a lever 23 which acts, through a cam, on a piston 43 connecting said cam to one portion of said box.

Thus, the translation means comprising two pairs of lower and upper wheels 24 and 25 (only two thereof being visible in the drawings) carried rotatably on arms 26 and 27 extending first in an orthogonal direction from the booth walls and then parallely to the building wall, by way of two lead-in apertures 28 and 29, will engage rotatably inside two parallel rails 30 (whereof only one is visible), advantageously of C-like configuration and simmetrically arranged to allow the wheels to run along their interior without ever leaving said rails.

Furthermore, to prevent the booth, in case of failure of the motors, from freely falling along the rails 30, there are provided locking means 31 controlled on turning a lever 32 which is arranged e.g. in the booth and, through the cam 33, will enable a concave wheel 34, mounted non-rotatably about its axis, to run and engage itself with a convex wheel 35 rigidly connected on the side surface of the gear wheel 8 to lock the latter and thus inhibit any movements of the booth.

The displacement of the concave wheel 34 through an actuating linkage 36 will force a wedge 37 into engagement between the wheels 24 and rails 30, thus further preventing the booth from moving along said rail.

Disengagement of the wedge 37 from the wheels and rails is achieved by its being automatically biased to its initial position by two springs 38.

To achieve full assurance of the booth being inhibited from moving along the rails upon failure, a toothed punch 39 carried on the gear wheel 8 is inserted in between the rack teeth.

Advantageously, both the rails and rack are traversed, either internally or externally, by a channel, not shown in the drawing, wherethrough a cooling fluid is flown to prevent the heat being generated by the fire from expanding or otherwise damaging the cited structures.

The operation of the inventive device may be appreciated from the foregoing description, and with special reference to FIG. 1, it may be seen that once the automobile vehicle transporting the booth has been driven to flank the building wall whereat the rails and racks are located, this is caused to slide, by means of the engagement device 19, transversely to the automobile vehicle box to insert the booth wheels 24 and 25 into the C-like rails through the lead-in apertures.

Then, by actuating the gear wheel, the booth is caused to move up along the wall, disengaging itself from the automobile vehicle that transported it there, and thus reach any floor in the building, both for fire extinguishing purposes and to rescue any people trapped by the fire therein.

It has been shown practically how the inventive device is particularly advantageous in that it has all parts intended to ensure correct operation of the booth and fire fighting arrangements doubled as in navy practice, and constructed from low expansion coefficient stainless alloys.

The invention as disclosed is susceptible to many modifications and changes without departing from the true scope of the instant inventive idea, and all of the details may be replaced with technically equivalent elements.

The invention can be completed with a number of further devices which can cope with particular circumstances. For example an elementary toilet can be provided in the booth for use when required due to the scare. Furthermore it can be advantageous to provide powerful blowers connected to flexible hoses for sucking the smoke after the fire has been estinguished. Other hoses or the same ones can be connected to blowers for blowing fresh air after the fire has been estinguished. It is possible to arrange heating means for the water furnished by the fire truck, when it is very cold. The booth can be provided with autonomous powerful lights for the use by night. At last it is possible to provide a tube for high pressure connected to the fire truck which in turn is connected to a hydrant, whereas the tube extends along the sky scraper and is attached to the racks and the rails. This tube can be provided with valves or taps for connecting thereto a water nozzle. Advantageously the valves are arranged at each floor of the building.

In practicing the invention, the material used, as well as the dimensions, may be any ones contingent on requirements and the state of the art. However, it must be pointed out that the elements which assure the functioning of the booth must be made of stainless alloys and have low dilatation coefficient.

I claim:

1. A fire escape and extinction system for buildings comprising in combination a booth adapted for transportation to a building on fire, and track structure adapted for extending substantially vertically on an external wall of said building and including at least one rail and at least one rack, parallel and coextensive with said rail, said booth comprising:

translation means adapted for releasable positive slideable engagement with said track structure for permitting movement of said booth along said track structure, driving means adapted for transmissive engagement with said track structure for driving said booth along said track structure, locking means adapted for selectively preventing said booth moving along said track structure, and, a partition grid, extending substantially parallel to a base of said booth, to define a lower chamber and an upper chamber therein, said lower chamber being adapted for accommodating at least said locking means, said upper chamber including at least one space, adapted to contain fluid for coaling said booth and being spaced apart from, and facing said partition grid.

2. A fire escape and extinction system according to claim 1 wherein said driving means include power assisted means adapted for driving at least one gear wheel, in rotary mesh engagement with at least one rack rigidly attached to an outside wall of a building and at least one arm, rigidly attached to said booth, rotatively carrying at least one wheel adapted for rotatably engaging the inside of at least one rail, defining a substantially C-like configuration attached to a wall of said building and defining at a lower portion thereof, at least one lead in aperture for said at least one wheel.

3. A fire escape and extinction system according to claim 1 wherein said locking means comprise at least one fixed concave wheel in sliding engagement with at least one convex wheel rigidly attached to a gear wheel of said driving means, said concave wheel including an actuating linkage for at least one wedge in removable engagement between a wheel of said driving means and said track structure.

4. A fire escape and extinction system according to claim 2 wherein said locking means further comprise a toothed punch, carried on said gear wheel and being adapted for insertion in between teeth formed on said at least one rack.

5. A fire escape and extinction system according to claim 1, further comprising an auxiliary platform and at least one winch connected to the exterior of said booth for supporting said auxiliary platform.

6. A fire escape and extinction system according to claim 1 wherein said track structure on said external wall of said building is covered with at least one protective film.

7. A fire escape and extinction structure according to claim 1 wherein said track structure comprises at least one passage channel for accommodating a cooling fluid.

8. A fire escape and extinction structure according to claim 1 wherein said booth further comprises a channel for topping up said fluid contained in said space, and atomizer nozzles, for directing delivery of said fluid from said space into said booth.

9. A fire escape and extinction structure according to claim 1 wherein said booth comprises a channel, for topping up said fluid contained in said space which includes at least one auxiliary facility valve.

10. A fire escape and extinction system according to claim 1 wherein said booth is adapted to be transported on a vehicle, including at least one sliding box, mounted on a frame of said vehicle and adapted for supporting said booth, said vehicle being provided with at least one engagement device for engaging said booth with said track structure.

* * * * *